United States Patent [19]

Spatz

[11] Patent Number: 4,820,070

[45] Date of Patent: Apr. 11, 1989

[54] DISPENSING DEVICE FOR COSMETIC STICKS AND THE LIKE

[75] Inventor: Walter Spatz, Pacific Palisades, Calif.

[73] Assignee: Spatz Laboratories, Marina Del Rey, Calif.

[21] Appl. No.: 630,759

[22] Filed: Jul. 13, 1984

[51] Int. Cl.[4] ..... A45D 40/00; A45D 40/06; A45D 40/12

[52] U.S. Cl. ..... 401/87; 401/68; 401/78; 401/86; 401/98

[58] Field of Search ..... 401/68, 75, 78, 98, 401/86, 87

[56] References Cited

U.S. PATENT DOCUMENTS

| | | | |
|---|---|---|---|
| 3,124,245 | 3/1964 | Hopgood | 401/78 |
| 3,332,429 | 7/1967 | Bates | 401/98 X |
| 3,333,740 | 8/1967 | Waller | 401/75 X |
| 4,208,144 | 6/1980 | Idec et al. | 401/78 X |

*Primary Examiner*—Steven A. Bratlie

*Attorney, Agent, or Firm*—Beehler, Pavitt, Siegemund, Jagger, Martella & Dawes

[57] ABSTRACT

A dispenser for stick type products such as cosmetics and the like which tend to shrink with age includes a novel cup or godet to prevent the stick from moving axially out of the cup. The interior wall of the cup includes a plurality of spaced axially disposed and radially inwardly projecting ribs of dove-tail cross-section. These ribs bite into the stick and function as dove-tail locks to prevent the outer surface of the stick from moving axially and rotationally with respect to the cup, even if stick shrinkage takes place. A screw type dispenser is also described as typical of the types of dispenser with which the cup may be used.

10 Claims, 1 Drawing Sheet

DISPENSING DEVICE FOR COSMETIC STICKS AND THE LIKE

FIELD OF THE INVENTION

This invention relates to dispensers for stick products, and more particularly to an improved dispenser for stick type products such as stick cosmetic products which tend to shrink over a period of time.

DESCRIPTION OF THE PRIOR ART

Dispensers for stick type products are well known in the prior art. One such form of dispenser commonly used for stick type product such as cosmetics, for example lipstick, eye shadow, eye liner, fragrances, mascara and the like, includes an outer tubular barrel which forms the housing for a stick product which is dispensed by moving the product axially within the barrel. The housing usually is covered by a cap, with the stick in a retracted position when not in use. When used, the cap is removed and the stick is advanced axially through the barrel by a screw arrangement to cause the leading end of the stick to project the desired amount beyond the open end of the barrel. After use, the stick is retracted into the barrel, again by the screw mechanism, and the cap replaced. There are other types of dispenser in which the stick is not axially moveable in a housing, but in which the stick is retained in fixed position in the housing.

In each of the described dispensers, the stick is mounted in a cup, sometimes called a godet. The prior art cups or godets generally are hollow cylindrical elements, usually of plastic, and include on the interior cylindrical surface a plurality of spaced, radially inwardly projecting splines which bite into the stick for the purpose of fixing the stick axially and rotationally relative to the cup. In these prior art devices the splines may be of a triangular cross-section, the base of which is at the inner wall interface and the body and apex of which extend radially inwardly into the stick. Another form of splines is generally rectangular in cross-section, again extending into the stick. In each case, the splines may include a tapered leading end, facing the open end of the cup, to ease the assembly operation of a preformed stick into the cup.

The stick may be preformed or may be poured into the cup during the assembly of the stick to the cup during the manufacturing operation. Many of the sticks, especially those used as cosmetic sticks, are of a composition which tends to shrink after some period of time since they may contain volatile materials or silicone materials used during compounding or which are present in the final product. Shrinkage usually takes places over a period of time after assembly, for example, several weeks. Thus, while the stick may initially appear to be firmly positioned axially and rotationally in the cup, after some period of time the radially inward shrinkage causes the stick to pull away from the inner wall of the cup with the result that the splines are not as deeply imbedded in the stick as they were originally. The result is that there may be insufficient bite into the stick by the splines to retard rotation of the stick relative to the cup. Also, there may be insufficient bite to prevent the stick from moving axially relative to the cup. The result is that if the dispenser is turned upside down and there is vibration, shock or repeated movement, the stick has a tendency to fall out of the cup. If this takes place there is adverse consumer reaction to the product which is quite understandable.

Accordingly, it is an object of this invention to provide an improved dispenser for stick type products, such as cosmetics and the like, wherein the stick is firmly locked in the dispenser and will not fall out even if shrinkage of the stick does take place over a period of time.

Another object of this invention is to provide an improved screw type stick dispenser for use with cosmetic stick type products wherein an improved cup structure is provided to assure that the stick remains locked in the cup even if the stick shrinks, so as to prevent the stick from falling out or becoming loose from the dispenser.

Still another object of the present invention is to provide an improved cup structure for use with dispensers of stick type products, such as cosmetic stick products, and especially adapted to be used with screw type dispensers in which the cup is advanced out of and retracted into a housing.

SUMMARY OF THE INVENTION

The present invention relates to dispensers for stick type products which exhibit a tendency to shrink some time after being assembled to the dispenser, and more particularly to an improved dispenser, preferably of the screw type for use with cosmetic sticks, wherein an improved cup assembly is provided which securely holds the stick in place to prevent axial movement of the stick relative to the cup even though shrinkage may occur over some period of time.

In accordance with this invention, which may be used with various types of dispensers for stick products, especially those of the cosmetic type, it has been discovered that the principal problem of the prior art dispensers may be overcome by the provision of an effective mechanism to lock the stick in the cup which forms part of the dispenser. Thus, the present invention finds particular use in those dispensers generally referred to in the art as screw type dispensers, of which there are numerous types. In one form, the inner surface of an outer housing includes a thread formed thereon which is used to advance and retract a cup or godet which is positioned within a sleeve supported in the housing. In another form, the screw thread is formed on the outer surface of a screw member, also supported within a housing such that the cup is moved axially as the screw is rotated.

To assure that the stick remains locked in the cup, the interior cylindrical wall of the cup is provided with a plurality of spaced axially extending ribs which project radially inwardly of the interior wall. At least some of the ribs are of dove-tailed cross-section, that is, the dimension circumferentially of the radial inward face of the rib is greater than the circumferential dimension of the rib at the inner wall. The ribs are located axially inwardly of the open end of the cup, i.e., that end of the cup from which the stick extends, and in that portion of the cup which forms the stick receiving region. In a preferred form, the stick receiving region is defined by a circumferentially extending shoulder which projects radially inwardly from the inner wall of the cup and which is axially spaced from the open end. The ribs preferably extend axially of the shoulder and terminate at their front end a short axial distance from the open end of the cup.

It is preferred that the front end of the ribs be rounded, but of dove-tailed cross-section, to facilitate assembly of preformed sticks into the cup. It is also preferred that the other end of the cup, beyond the shoulder, include an opening in order to permit the escape of air as the stick is assembled to The ribs perform their effective locking action by preventing axial movement of the stick relative to the godet even if shrinkage does take place. As the stick shrinks, it pulls away from the interior wall of the cup. The ribs, at least some of which are constructed in accordance with this invention, operate to hold the stick to prevent axial movement because of the dove-tail configuration. In effect, the ribs of this invention hold the stick in mid-air to prevent axial movement as contrasted to pointed ribs or generally rectangular ribs. In any event, a sufficient amount of the ribs remains locked in the stick to prevent movement relative to the cup, but more importantly, the stick is secured axially in the cup even though there may have been some shrinkage.

As will be apparent from the following detailed description, the improved cup and dispenser of the present invention have many advantages over the prior art devices, as will be apparent to those skilled in the art. The following detailed description, with reference to the accompanying drawings, are for the purposes of illustrating the principles of this invention; but it is to be understood that such detailed description is not to be taken in a limiting sense, since the scope of the present invention is as set forth in the appended claims.

DETAILED DESCRIPTION OF THE PREFERRED EMBODIMENT

Figures 1, 2, 3, 4:
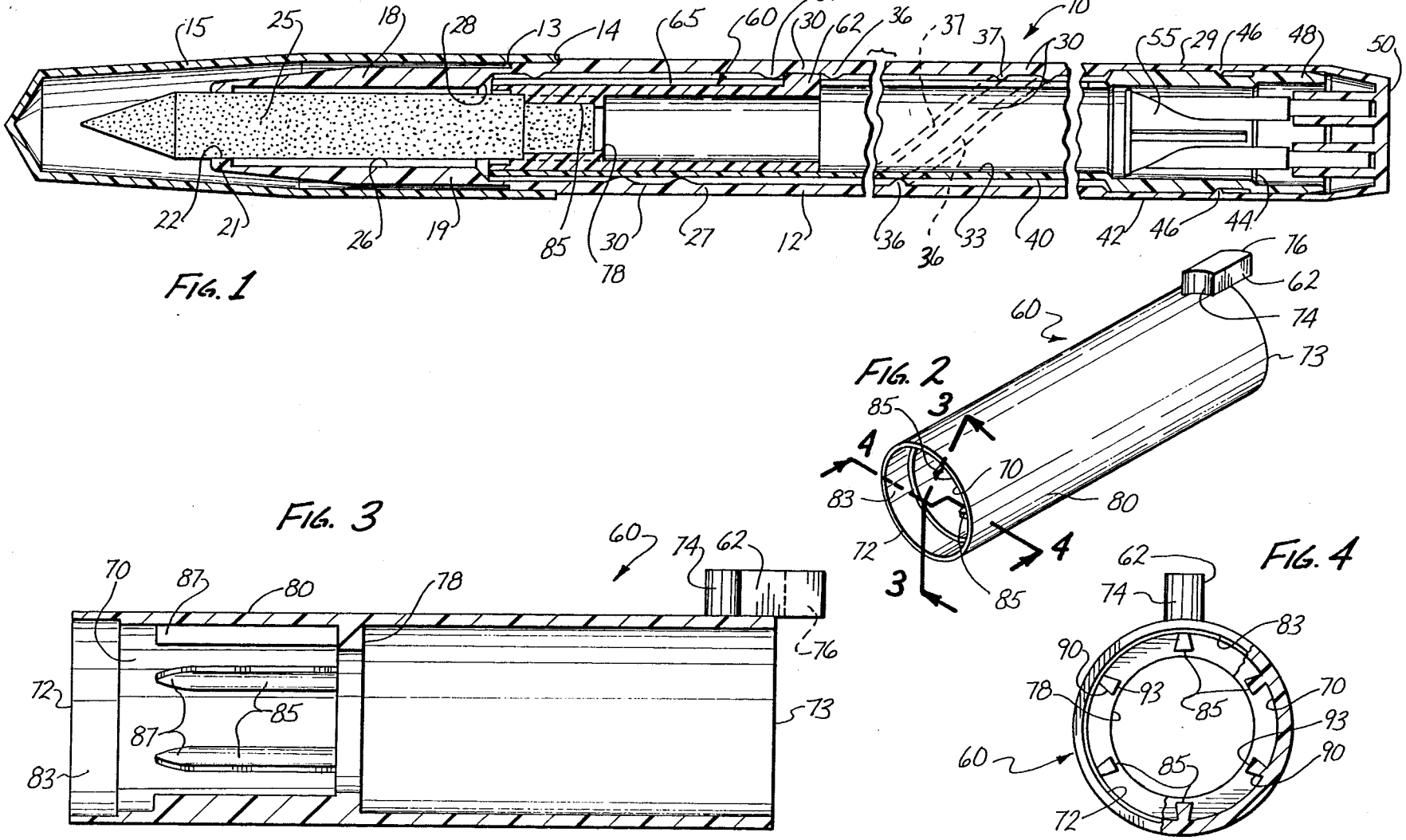
FIG. 1 is a view, partly in section and partly in elevation, and on a much enlarged scale, of a stick dispenser in accordance with the present invention.
FIG. 2 is a perspective view, on a much enlarged scale, of the improved cup or godet of the present invention.
FIG. 3 is a view, partly in section and partly in elevation, taken along the line 3—3 of FIG. 2.
FIG. 4 is a view, partly in section and partly in elevation, taken along the line 4—4 of FIG. 2.

Referring to the drawings which illustrate a preferred form of the present invention, FIG. 1 shows a pencil dispenser 10 for purposes of explanation. It is to be understood, as previously mentioned, that the present invention may be used with any of the dispensers known in the art and the form shown is for illustrative purposes only. The dispenser includes an outer housing or barrel 12 whose outer surface is generally cylindrical for cosmetic purposes. Other external shapes may be used if desired. The forward end of the barrel 12 includes two stepped shoulders 13 and 14, the former acting as a guide for the cap 15 which is received against shoulder 14. The portion of the barrel between the shoulders 13 and 14 is dimensioned such that the cap 15 is frictionally held on the barrel, but is removable.

The section 18 of the barrel forward of the shoulder 13 is configured as a guide and includes a thickened section 19, which gradually tapers in cross-section to a front end 21 which includes an inner annular pad 22 which guides and supports the stick element 25. The interior 26 of the guide section 18 is slightly larger in diameter than the outer diameter of the stick so as to provide the clearance as shown. The center section 27 of the barrel, which extends from the shoulder 28 to the enlarged end section 29, includes a generally helical thread 30 formed on the inner surface 33 thereof by two spaced spiral projections 36 and 37 as shown. The spiral projections also form a support pad for a sleeve member 40 received in the interior of the barrel, the end 42 of the sleeve being enlarged, as shown, and being received in the enlarged end 29 of the barrel. The end of the sleeve also includes a circumferential groove 44 which fits with the land 46 on the end of the barrel so that the two parts are fixed together axially, but are free to rotate relative to each other. The bottom tip end 48 of the sleeve includes serrations while the button 50 also includes interior serrations so as to grip the end of the sleeve to effect rotation of the sleeve. As shown, the button may support a pencil sharpener 55.

Received within the sleeve is a cup 60, the latter including a stud 62 which travels in an axial slot 65 provided in the sleeve. To cause travel of the cup, one of the sleeve or barrel is rotated relative to the other, with the result that the stud is caused to move axially in the slot 65 to advance or retract the cup 60 and the pencil 25. As shown, the outer diameter of the cup is less than the inner diameter of the sleeve, and the inner diameter 26 of the guide 18 and thus the pad 22 acts as a stop for advancing movement of the cup. Retracting movement of the cup is stopped by arranging the leading end of the thread 30 a short distance axially away from the base of the slot.

Referring now to FIGS. 2–4, the cup 60 is an elongated member having a hollow cylindrical interior wall 70 with an open end 72. The stud 62 is positioned on the bottom end 73 of the cup and includes top and bottom faces 74, 76 which are parallel, but angled with respect to the long center axis of the cup, the angle corresponding generally to the helix angle of the thread pitch. The faces 74–76 ride on the protrusions 36–37 as the cup is moved axially. Spaced from the open end 72 of the cup is an inner circumferentially extending shoulder 78 which projects radially inwardly. The region 80 between the open end of the cup and the shoulder forms the stick receiving portion of the cup. The open end of the cup may be counterbored, as at 83, to form a guide for insertion of a preformed stick into the cup. Between the open end of the cup and the shoulder 78, the interior wall of the cup includes a plurality of spaced axially oriented radially inwardly projecting ribs 85, six being shown for purposes of illustration. Each rib includes front portion 87 which is rounded, as shown, for ease of insertion of a stick into the cup, the front portion being spaced from the open end of the cup so that the base end of the stick may be properly positioned within the cup before the ribs begin to bite into the stick.

As illustrated in FIG. 4, and in a preferred form, each rib includes a root section 90 where the rib joins the wall 70, the root dimension, as measured circumferentially, being smaller than the circumferential dimension of the face 93 which constitutes the radial inward face of the rib. As shown, the ribs are preferably formed integrally with the wall, as is the shoulder 78, the latter acting as a bottom stop for the stick during insertion. Thus, the ribs are essentially dove-tail in cross-section, even to the front end thereof. The cup preferably includes an open end adjacent the stud, to prevent trapping of air during assembly of the stick. Further, the cup is somewhat longer in length than needed simply to hold the stick, the added axial length operating to prevent the cup from binding during axial movement. As is apparent, it is not necessary that each rib be dove-tailed for the purpose of locking. The locking effect can be achieved if some of the ribs are dove-tailed, as described.

In operation, as the stick is assembled to the cup, by procedures well known in the art, the ribs bite into the stick and, in effect form a dove-tail joint with the stick. Initially the formed diameter of the stick is such that the outer periphery of the stick contacts the inner wall of the cup, including those wall portions between adjacent ribs. As the stick begins to shrink, for the reasons already described, the dove-tail lock prevents the outer periphery of the stick from pulling away from the side walls of the ribs. The effect is that the stick is retained axially in the cup as well as being prevented from rotating with respect to the cup. Accordingly, when the dispenser is turned upside down and shaken or vibrated, the stick is retained and does not come out of the cup, as has occurred with prior art structures.

The process for assembling the dispenser and for assembling a preformed stick or a poured stick to the cup are well known.

Even though the invention has been described in terms of the embodiment set forth in detail for purposes of explanation, it should be understood that the disclosed form is for the purpose of illustration and that the practice of the invention is not limited thereto. Alternate forms and embodiments will be apparent to those skilled in the art in view of this detailed disclosure. Thus, modifications are contemplated which can be made without departing from the scope and spirit of the described invention.

What is claimed is:

1. In a dispenser for use with a stick type product in which the stick type product tends to shrink radially with the passage of time, wherein said dispenser includes a housing for said stick type product, an improved cup member for supporting said stick type product with said housing, said cup member comprising:

a hollow member having an opening at one end thereof and an interior cylindrical wall, said hollow member being adapted to receive a stick type product initially dimensioned such that the outer surface of said product is in contact with said cylindrical wall and wherein said product tends to shrink radially with time, said wall including a plurality of spaced, radially inwardly extending ribs disposed axially of said cup member, and at least some of said ribs having a root dimension at the junction of said wall which is of a dimension less than the dimension of the radially inwardly extending surface thereof whereby said ribs engage said stick type product to lock the same within said cup member to prevent axial and rotational movement of said stick type product as the latter shrinks.

2. A dispenser as set forth in claim 1 wherein the base of said cup member is open to prevent air from being trapped in said cup member during assembly of the stick type product thereto.

3. A dispenser as set forth in claim 1 wherein each of said ribs is dove-tailed in cross-section.

4. A dispenser as set forth in claim 1 further including:

a screw mechanism supported in said housing, and said cup member mounted in said housing for axial movement with respect to said housing by said screw mechanism to advance and retract said cup member and the stick type product mounted therein.

5. A dispenser as set forth in claim 4 wherein said cup member includes a stud on the end thereof opposite the open end for engagement with said screw mechanism.

6. A dispenser as set forth in claim 1 wherein said ribs are located axially inwardly of the open end of said cup member, and said ribs including a leading front end which is rounded to facilitate entry of said rib into a preformed stick type product as the latter is assembled into said cup member.

7. A dispenser as set forth in claim 6 wherein the interior wall of said cup member includes a radially inwardly extending shoulder, said ribs including a tail end remote from the leading end thereof, and the tail end of said ribs being in contact with said shoulder.

8. A cup for receiving a stick type product, such as a cosmetic stick and the like, wherein said stick tends to shrink over a period of time, comprising:

an elongated body having a cylindrical interior inner wall and an opening at one end thereof, a radially inwardly extending shoulder located on said inner wall and spaced axially from said opening to define the stick receiving section of said cup, a plurality of axially disposed and radially inwardly projecting ribs on said inner wall and located between the open end of said cup and said shoulder, and each of said ribs being dove-tailed in cross-section such that the radially inwardly projecting surface thereof is of a circumferential dimension greater than the circumferential dimension of the portion of the rib which is adjacent to said inner wall whereby said ribs lock a stick assembled to said cup to prevent axial and radial movement of said stick relative to said cup in the event of shrinkage of said stick.

9. A cup as set forth in claim 8 wherein said cup includes a cylindrical outer wall, and wherein the end of said cup opposite the open end includes a lug mounted on the outer wall adapted for engagement with a screw assembly.

10. A cup as set forth in claim 8 wherein each of said ribs includes a leading front end spaced from the open end of said cup, and wherein the leading end is rounded, but of dove-tailed cross-section, to facilitate assembly of a preformed stick into said cup.

* * * * *